428-408
6/3/80 OR 4,206,263

United States Patent [19]
Rieger et al.

[11] 4,206,263
[45] Jun. 3, 1980

[54] OXYGEN-RESISTANT ELECTROCONDUCTIVE CARBON BODIES

[75] Inventors: Hans W. Rieger, Buch; Hanspeter Alder, Flurlingen, both of Switzerland

[73] Assignee: Swiss Aluminium Ltd., Chippis, Switzerland

[21] Appl. No.: 847,047

[22] Filed: Oct. 31, 1977

Related U.S. Application Data

[63] Continuation-in-part of Ser. No. 818,080, Jul. 22, 1977, abandoned.

[30] Foreign Application Priority Data

Sep. 16, 1977 [CH] Switzerland ..... 11347/77

[51] Int. Cl.[2] ..... B32B 9/04; B05D 5/12

[52] U.S. Cl. ..... 428/408; 204/38 R; 204/39; 204/290 R; 204/294; 313/345; 313/355; 427/34; 427/35; 427/113; 427/126.4; 428/446; 428/539

[58] Field of Search ..... 428/408, 446, 539; 427/113, 431, 126, 34; 204/39, 290 R, 294, 38 R, 52 R; 313/345, 355

[56] References Cited

U.S. PATENT DOCUMENTS

| | | | |
|---|---|---|---|
| 3,342,627 | 9/1967 | Paxton et al. | 428/408 |
| 3,829,374 | 8/1974 | Kugler et al. | 204/290 R |
| 3,941,899 | 3/1976 | Kugler et al. | 427/113 |

FOREIGN PATENT DOCUMENTS

| | | | |
|---|---|---|---|
| 1375553 | 11/1974 | United Kingdom | 427/113 |
| 197529 | 4/1966 | U.S.S.R. | 204/290 R |

*Primary Examiner*—Stanley S. Silverman
*Attorney, Agent, or Firm*—Bachman and LaPointe

[57] ABSTRACT

The minute pores and discontinuities which are normally present in protective oxide coatings on carbon bodies can be closed and, if desired, filled by immersing the coated carbon body in a metal salt melt having a boiling point above 400° C., and electrodepositing the melt on the coated carbon body. When the electrodeposition step is continued sufficiently long to fill the pores, the product when cool is a coated carbon body carrying an oxidation agent-resistant coating which is keyed into the surface of the carbon.

36 Claims, 3 Drawing Figures

OXYGEN-RESISTANT ELECTROCONDUCTIVE CARBON BODIES

Figure 1:
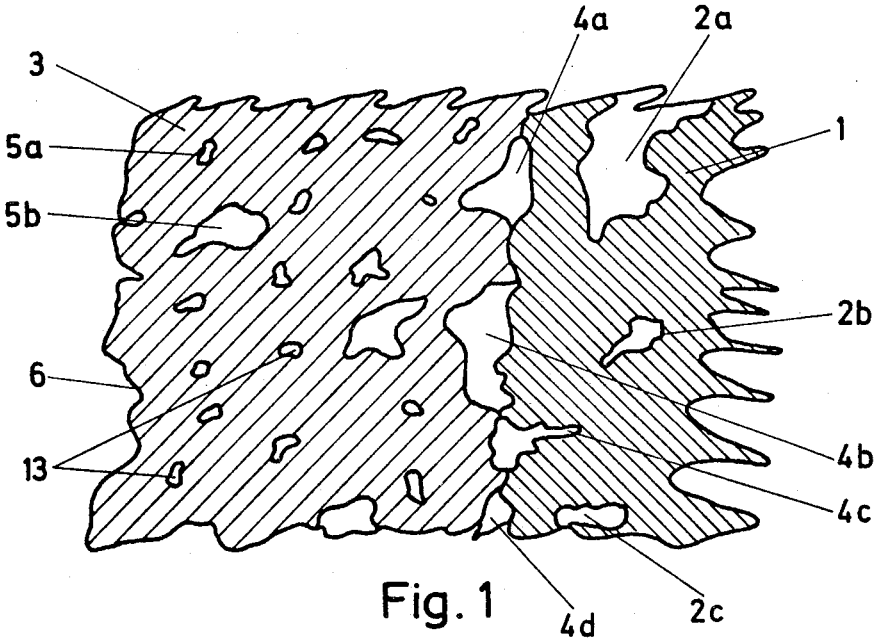

This is a continuation-in-part of our application Ser. No. 818,080 filed on July 22, 1977, now abandoned, which will be replaced by the instant application.

FIELD OF INVENTION

The present invention relates to long-life composite electroconductive carbon bodies suitable for use in the electrolysis of fused salts and for the melting of metals. The invention includes the composite bodies themselves and methods for their manufacture.

BACKGROUND OF INVENTION

Kugler et al U.S. Pat. Nos. 3,829,374 and 3,941,899 disclose that an electrode composed of a carbon body having a coating of alumina particles fused thereto possesses improved durability. The fused and re-solidified coating (typically 0.1 to 1 mm thick) protects the surface of the carbon body projecting out of the melt from attack by oxidation agents and thus extends the life of the electrode when it is exposed to the action of oxygen at high temperature, as when it is used as an anode in the production of aluminum by fusion electrolysis. In this process (the Hall process) alumina is electrolyzed at temperatures in the range of 950° C. to 1000° C., and in this range the oxygen evolved from the fused salt mixture, the oxygen in the atmosphere and other oxidation agents react rapidly with the carbon in the electrode.

While the parts of these electrodes projecting out of the melt disclosed in these patents possess greatly improved resistance to attack by high temperature oxidation agents, experience has shown that oxidation agents slowly pass through the aforesaid coating and slowly consume the carbon. Complete protection has not been achieved by increasing the thickness of the coating, because, as has now been found, the coating is not uniformly fused to the carbon but contains discontinuities through which oxygen passes, causing a destruction effect at the high temperature at which the electrodes are used.

THE INVENTION

The discovery has now been made that the working lives of electrodes and of electroconductive composite carbon bodies such as are disclosed in the above-mentioned patents can be extended by filling or closing the surface pores of the carbon body and of the discontinuities in the refractory oxide coating with a refractory oxidation agent-impermeable material with a boiling point above the working temperature of the electrolyte or the molten metal in which the use of the composite carbon body is provided but in excess of 400° C., and that this can be accomplished by an electrodeposition step at low voltage.

We have found that this can be done by immersing the carbon body (carrying a refractory particulate coating of alumina or similar material having pores and discontinuities as described) in a melt of a refractory material which has a boiling point in excess of 400° C., and imposing a negative voltage on the carbon so that the carbon becomes a cathode, the voltage being sufficiently low so that decomposition of the melt does not occur. We have found that the electrodepositing action of the current very rapidly closes or seals the pores and discontinuities, thereby insulating the carbon from contact with any oxidation agent, and that when the duration of the electrodeposition is extended, the pores and discontinuities become filled with the sealant material, which thereby provides further protection.

The effect of the foregoing in preferred instances is to increase very greatly the oxidation resistance of the electrode when it is used as an anode in the production of aluminum, magnesium, etc., and when it is used as a construction element in melts of refractory materials or metals at elevated temperatures, e.g. 1000° C.

The presence of a fused oxide coating at the start of the electrodeposition step is critical. Absent the coating, the carbon body, after the electrodeposition step, is substantially wholly consumed by oxygen in 18 hours in a standard oxidation test. With the coating present, the carbon body is substantially unaffected by 72 hours of the same test.

The electrodeposition step is likewise critical. Absent the application of a negative electric potential to the carbon, only incomplete sealing of the surface takes place when the oxide-coated carbon is immersed in the refractory melt. When the electric potential is applied, substantially complete sealing of the surface can be achieved.

When the electrodeposition step is continued sufficiently long to fill a substantial proportion of the surface pores of the carbon body, the coating is thereby structurally keyed into the carbon body.

The process of the present invention is thus a method for improving the resistance of the surface of an electroconductive carbon body against attack by oxidation at the temperature of fusion electrolysis, said surface having pore openings and carrying an adherent discontinuous coating composed of a refractory metal oxide, which comprises the step of (1) immersing said body into a refractory metal salt melt having a boiling point in excess of 400° C.; (2) electrodepositing said melt on the thus-coated carbon body thereby closing practically all of said pore openings and discontinuities with said melt; and (3) removing said body from said melt before said oxide coating has wholly desintegrated or dissolved. The body is thereby provided with a continuous coating of refractory material, practically all pore openings in the carbon body being filled with the refractory material and the coating thus intimately linked to the carbon surface. The present invention is thus an improvement on the inventions of the patents which are referred to above.

The starting composite body is preferably prepared by plasma-coating at least part of a carbon body or shaped form with a refractory oxide thereby depositing on said body an adherent coating of particles of said oxide. The coating, however, is not completely adherent and therefore necessarily contains discontinuities (pores and cracks) which permit oxidation agents to pass through to the underlying carbon. The coating need be no thicker than 1000 $\mu$; it should be at least 50 $\mu$ thick. A thickness of 200 $\mu$ to 300 $\mu$ is preferred, as in this range the coating provides substantially as complete protection of the surface as can practically be obtained without excessive use of time and material.

The product of the invention is an electro-conductive carbon body defining an external surface having pores, and a protective, refractory oxidation agent—impermeable coating disposed on at least a portion of said surface of said carbon body and essentially composed of a refractory oxide and a refractory compound which has a boiling point in excess of 400° C., said coating being continuous and extending through said portion into substantially all of said pores thereby closing them to access of oxygen.

In a preferred instance, the product is a carbon body having a normally porous surface, an adherent discontinuous coating of a refractory oxide fused to said surface, and a protective, refractory, oxidation agent-impermeable continuous outer coating of a salt or salt mixture having a boiling point in excess of 400° C., closing and filling substantially all the pores of said carbon surface and the discontinuities in said fused coating, said outer coating being keyed into the surface pores of the carbon.

Figure 2:
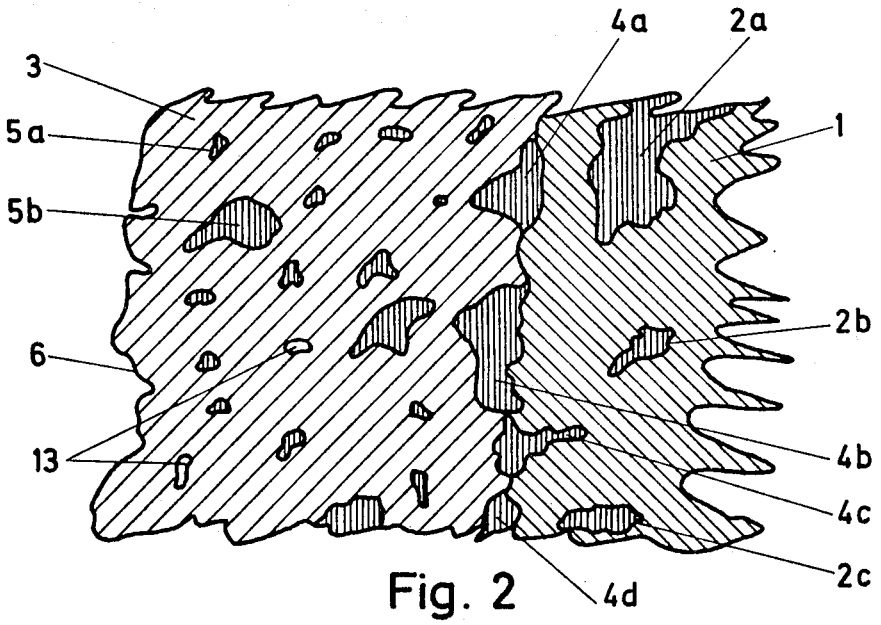
Figure 3:
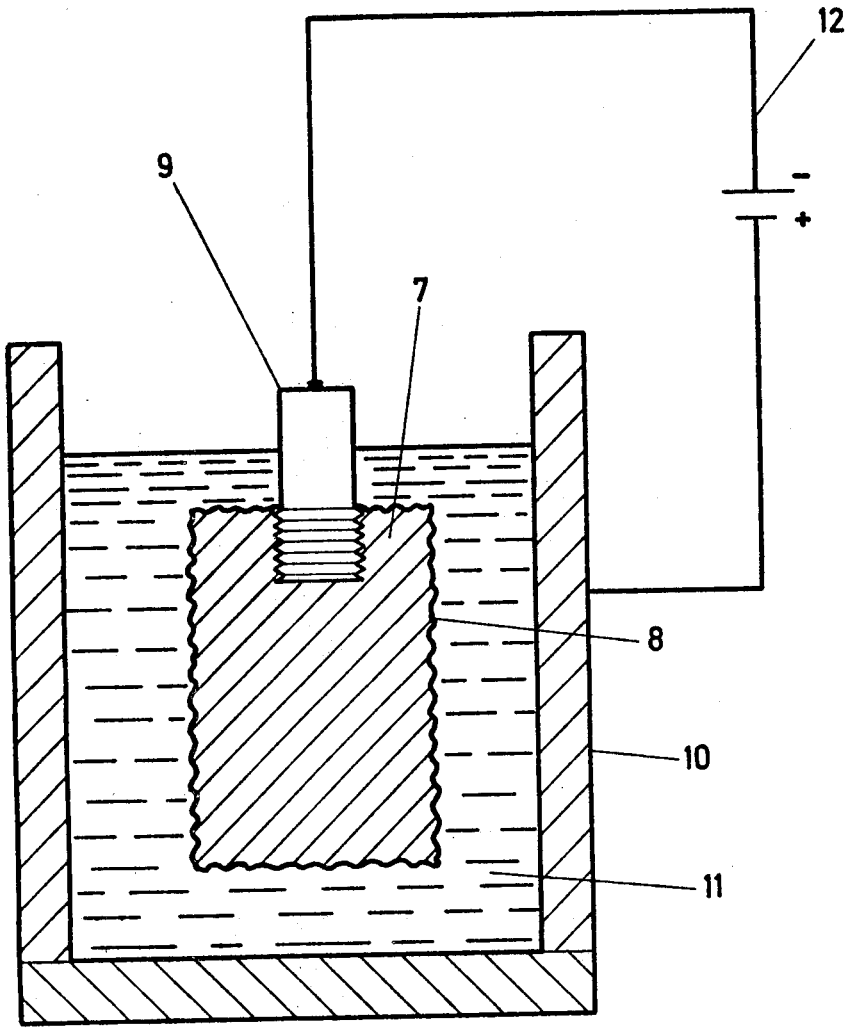

The invention is further described in the drawing wherein, on a greatly enlarged scale, FIG. 1 represents a vertical section of an outer portion of a porous cylindrical carbon body carrying an adherent coating of refractory oxide material containing pores and discontinuities;

FIG. 2 represents the portion of the carbon body shown in FIG. 1 with some of the pores and discontinuities closed by the melt and with some of the pores and discontinuities filled by the melt; and FIG. 3 is a vertical section, shown schematically, through an apparatus suitable for the treatment of a carbon body such as is shown in FIG. 1 with a melt according to the process of the present invention.

FIGS. 1 and 2 were prepared from several photomicrographs at ×175 and show schematically the principal composite features of these photomicrographs.

In FIG. 1, 1 designates the carbon structure of the composite body; 2*a*, 2*b* and 2*c* designate three typical pores in the carbon; 3 designates a coating composed of refractory oxide particles and solidified solvent for the refractory oxide; 4*a*, 4*b*, 4*c* and 4*d* designate typical voids between the oxide coating and the carbon; 5*a* and 5*b* designate open pores in the refractory oxide coating, and 6 designates the exposed surface of the fused oxide coating. 13 designates closed pores. The aforesaid pores, voids and discontinuities may communicate with the atmosphere through channels (not shown) above and below the plane of the drawing.

In FIG. 2, the electrodeposited material is shown by vertical shading. Numerals 1 and 3 have the same significance as in FIG. 1, and numerals 2, 4, 5, 6 and 13 identify the pores, voids, discontinuities and exposed surface of FIG. 1. The open pores, voids and discontinuities have been filled with the deposited material as shown by vertical shading. The coating is keyed into the carbon by filling the surface pores of the carbon, i.e. voids identified 4*a*, 4*b*, 4*c* and 4*d*.

In FIG. 3, 7 represents an electroconductive carbon body having a refractory coating of oxide material 8 and electric terminal 9; 10 represents a conductive container acting as an anode enclosed in a furnace containing conventional heating means (not shown); 11 designates a fused refractory salt; and 12 represents a low voltage source of direct current having a polarity which makes the electroconductive body the cathode and the fused refractory salt the anode.

More in detail, the composite electroconductive bodies of the present invention are most conveniently prepared from a carbon body (which possesses normal porosity and which can be amorphous carbon or graphite) which carries an adherent partially fused and resolidified coating of a refractory metal oxide. Such a body is readily prepared by spraying the body with droplets of the desired oxide at sufficient temperature and velocity to cause them to adhere to the sprayed surface. Preferably, the oxide is applied by means of a plasma burner, the temperature of the plasma discharge being sufficiently high so that the oxide is discharged at a temperature at which it is molten.

Prior to the spraying operation the carbon surface is sandblasted gently as to provide a clean surface which ascertains roughness for good adhesion.

The coating is composed of any refractory inorganic oxide which is inert to oxidation, that is, an oxide which is solid at the temperature of the solvent bath in which the carbon body is to be immersed. Aluminum oxide, chromic oxide and silicon dioxide are useful for the coating, and other similar refractory oxides can be used.

A water-stabilized plasma gun having a 150 kW power input and a spray output of 20 kg per hour is suitable for the formation of the coating. A satisfactory coating is achieved when the distance between the gun and the carbon surface is about 15–30 cm, and the oxide particles which are discharged from the gun are largely in the size range of 75μ to 150μ. The size of the particles is not critical, and good results are obtained when the particles are 10μ to 200μ in diameter.

The resulting coated carbon has a frosted appearance. When the oxide is alumina or silica, the coating is whitish, and when the oxide is chromic oxide, the coating is greenish.

The coating can also be applied by brushing an aqueous suspension of oxide particles on the carbon, allowing the coating to dry, and then baking the coated carbon at elevated temperature (for example, 200°–300° C.) for several hours to cause the coating to adhere. The oxide coating on the body may include particles that have a diameter between about 1μ and 200μ.

The pore openings and discontinuities in the resulting coated carbon body according to the invention are filled by immersing the coated body in a melt of a molten refractory salt and applying low-voltage direct current to the carbon body so that it is negative to the melt at a potential which does not cause decomposition of the melt. The molten material enters the pore and discontinuities in the oxide coating, and likewise enters and fills the minute open pores of the carbon body. Finally all the pores and voids will be closed. As a result, the entire surface of the starting oxide-coated body can be substantially completely protected against access of high temperature oxidation agents. Examples of such oxidation agents, which are generally in a gaseous form, are $O_2$, air, $F_2$, $Cl_2$, $CO_2$, $NO_2$ and/or $SO_2$.

In the melt, the carbon body is the cathode. The voltage which is applied to the carbon varies from material to material, and a suitable voltage in any instance can readily be determined by trial, too high a voltage being evidenced by formation of decomposition products in the bath.

It is advantageous for the current to be applied to the carbon body as soon as the carbon body has been immersed in the melt.

The carbon body is allowed to remain in the melt until substantially complete filling of the surface pores of the carbon and of the discontinuities in the oxide coating occurs. It should be removed from the melt while at least some of the refractory oxide coating remains on the body.

Removal of the refractory coating resulting from too long immersion in the melt is most easily determined by subjecting a series of treated carbon bodies to an oxidation test. A sharp change in the oxidation resistance of one member of the series and the next is evidence that the refractory oxide coating has been substantially or completely removed.

The optimum duration of the immersion and electrodeposition treatment varies from instance to instance, but in each instance, the optimum can be readily determined by laboratory trial. In practice, satisfactory results are achieved when the duration of the electrodeposition step is in the range of 1 to 60 minutes. Electrodeposition durations in the range of 5 to 20 minutes have provided excellent results and this range is therefore preferred.

The melt can be composed of any oxidation agent-resistant material which has a boiling point in excess of 400° C. Thus, it can be a refractory halide, for example cryolite (preferably rendered more electroconductive by a small dissolved amount of alumina or similar material) or an alkaline metal chloride, or a 55–95:45–5 by weight alkaline metal chloride:$AlCl_3$ mixture. Preferably, the melt is composed of cryolite and alumina in 85–95:15–5 weight ratio. The melt is applied at a temperature at which it is sufficiently fluid to penetrate the discontinuities, and in the case of melts based on cryolite, temperatures in the range of 950° C. to 1000° C. are suitable.

The time required to effect closure of the pore and discontinuity openings generally is at least about one minute and may be slightly longer, depending on the viscosity of the melt and the pore size distribution. Preferably, the coated carbon body is allowed to remain in the melt until substantially all of the pore openings and discontinuities have been closed. The coated carbon body can be allowed to remain in the melt longer, until the pore openings and discontinuities have substantially filled with the melt, and this generally occurs within 60 minutes.

At the end of the desired period of immersion, the carbon body is removed from the melt and cooled to a temperature at which the adherent melt is solid. If desired, the carbon body can be cooled to room temperature. They may be used in the same manner as the electrodes of the Kugler et al patents cited above. Instead of cooling, it can be allowed to cool, with or without annealing.

When the melt is the preferred cryolite-alumina solution, the dissolved alumina separates from the cryolite as the cooling progresses and on microscopical examination can be observed as a separate crystalline phase, generally acicular in appearance.

The invention is more particularly described in the examples which follow. These examples represent preferred embodiments, and the invention is not to be construed as limited thereto.

EXAMPLE 1

The following illustrates the preparation, according to the present invention, of sealed electroconductive carbon body suitable for use in fusion electrolysis and in the electric melting of metals, wherein the plasma-jet applied coating is alumina and the sealant of the exposed pores and of the discontinuities is cryolite having a minor content of alumina.

After sand-blasting the entire surface, a cylinder of porous carbon (graphite) 5 cm in diameter and 6 cm high provided with an electric terminal (a carbon stud threaded into a 0.75 cm hole at the center of one end) is sprayed over its entire surface (including bottom and top) with particles of molten alumina (about 50 μ to 200 μ in diameter) from a plasma burner as described in Kugler et al U.S. Pat. No. 3,829,374 until a coating of alumina about 300 μ thick has formed thereon. The coating is adherent. From microscopic examination of a section of an electrode previously prepared in similar manner, it is known that the coating is discontinuous and that the discontinuities expose some of the pores of the carbon to the atmosphere. It is furthermore known that voids communicating with the atmosphere underlie the coating thereby exposing additional areas of the carbon to the atmosphere.

The coated carbon cylinder is then immersed in a melt (temperature 988° C.) composed of 90 parts by weight of cryolite and 10 parts by weight of alumina in an electric furnace. A cathodic current of 8 amperes at 1.8 volts is applied to the cylinder (current density 0.037 $A/cm^2$) through the carbon terminus. The current is applied as soon as the cylinder is immersed in the melt, and is continued for 10 minutes, when it is turned off and the cylinder is immediately removed. The resulting electrode is allowed to air cool to room temperature. The cylinder gains 6 g in weight, and is of whitish, frosted appearance. A body of carbon with a length of 1000 mm, a width of 500 mm and a height of 400 mm prepared in the manner described above is suitable for use in the manufacture of aluminum from molten cryolite by the Hall method at a temperature in the range of 950° C. to 1000° C.

EXAMPLE 2

The electrode of Example 1 is tested as follows to determine its resistance to attack by oxygen.

The electrode is weighed and is immersed to the depth of about 2 cm in a pool of liquid aluminum at an average temperature of 650° C. within the range of 620° to 680° C. in an electric furnace having a volume of about three liters. Air is blown over the surface of the melt at the rate of 5 liters per minute.

At the end of 72 hours, the electrode is removed, allowed to cool to room temperature, reweighed, and examined optically and mechanically for surface flaws and loosening of the coating.

The electrode loses 0.47% of its weight in the test and is rated "very good" in the optical and mechanical examination.

An electrode prepared in the same manner except for the plasma coating step loses more than 80% of its weight during the first 18.5 hours of the test, and in the mechanical examination is rated as being substantially totally oxidized.

EXAMPLE 3

The procedure of Example 1 is repeated except that the temperature of the cryolite-$Al_2O_3$ bath is increased to 995° C. After 24 hours of the test of Example 2, the electrode loses 1.44% of its weight and is rated "very good" after optical and mechanical examination.

EXAMPLE 4

The procedure of Example 1 is repeated except that the current density is 0.074 $A/cm^2$. The electrode loses 1.44% of its weight when subjected for 24 hours to the test of Example 2.

EXAMPLE 5

The procedure of Example 1 is repeated except the powdered chromic oxide ($Cr_2O_3$) is employed as the plasma jet spray in place of the $Al_2O_3$ used in Example 1, and the product is provided with a protective coating by immersion for about 60 minutes in a 90% cryolite-10% alumina bath at 960° C. with a current density of 0.15 A/cm$^2$. The properties of the resulting electrode are similar to those of the electrode of Example 1.

EXAMPLE 6

An aqueous suspension of paint-like viscosity of a mixture of 70% cf $Al_2O_3$ particles of 1 $\mu$ to 100 $\mu$ diameter and 30% by weight of an aqueous aluminum-monophosphate solution having a concentration of 30% by weight with particles of about the same size is brushed on a cylindrical carbon body by use of a paint brush. The painted carbon body is allowed to dry at 70° C. for half an hour and is baked at 250° C. for two hours to cause the coating to adhere.

The coated carbon is then subjected to the molten salt bath of Example 1 for 10 minutes. When cool, the carbon is encased in a continuous oxygen resistant coating which is keyed into the carbon body.

EXAMPLE 7

The procedure of Example 1 is repeated except that the melt consists of sodium chloride and the melt temperature is 800° C. The electrode loses 1.72% of its weight when subjected for 24 hours to the test of Example 2.

What is claimed is:

1. An electroconductive body for use in the electrolysis of fused metal salts characterized by improved resistance to oxidation agents at elevated temperatures comprising in combination:

(a) a carbon body;

(b) a first protective oxide coating disposed on said carbon body, said first protective oxide coating being characterized by minute pores and discontinuities; and (c) a second electrodeposited protective oxide coating disposed within said pores and discontinuities, said second protective oxide coating comprising an oxidation agent impermeable metal salt having a boiling point in excess of 400° C.

2. An electroconductive body according to claim 1, wherein the carbon body is graphite.

3. An electroconductive body according to claim 1, wherein said oxidation agent-impermeable coating covers substantially all of the surface thereof.

4. An electroconductive body according to claim 1, wherein said oxide is alumina.

5. An electroconductive body according to claim 1, wherein said oxide is chromic oxide.

6. An electroconductive body according to claim 1, wherein said oxide is silica.

7. An electroconductive body according to claim 1, wherein the refractory metal salt in said protective coating is cryolite.

8. An electroconductive body according to claim 7, wherein said cryolite contains alumina in about 85–95:-15–5 weight ratio.

9. An electroconductive body according to claim 1, wherein the refractory metal salt in said coating is an alkaline metal chloride.

10. An electroconductive body according to claim 1, wherein the refractory metal salt in said coating is a mixture of an alkaline metal chloride and aluminum chloride in 55–95:45–5 weight ratio.

11. An electroconductive body possessing improved resistance to oxidation agents at 400° C. comprising in combination:

(a) a carbon body having a first porous oxide coating; and (b) a protective refractory, oxidation agent impermeable electrodeposited second coating disposed in said pores of said first coating and composed essentially of (1) a metal oxide and (2) a refractory metal salt which in the molten state is a solvent for at least a part of said second coating.

12. A process for improving the resistance of the surface of an electroconductive carbon body against attack by oxidation agents at 400° C., said surface having surface pore openings and carrying an adherent discontinuous coating composed of refractory oxide particles, which comprises:

(a) immersing said body into a non-oxidizable refractory metal salt melt, having a boiling point in excess of 400° C.;

(b) applying a continuous voltage, said voltage being below the disassociation voltage of the non-oxidizable refractory metal salt, using said carbon body as cathode;

(c) electrodepositing said metal salt melt on said body thereby closing substantially all of said pore openings and discontinuities with said metal salt melt; and (d) removing said body from said metal salt melt before said oxide has completely disintegrated or dissolved.

13. A process according to claim 12, wherein said body is immersed in said melt sufficiently deeply to contact substantially all of said refractory oxide coating with said melt.

14. A process according to claim 12, wherein said electrode is substantially completely covered by said porous coating and said electrode is substantially completely immersed in said melt.

15. A process according to claim 12, wherein said melt is non-oxidizable.

16. A process according to claim 12, wherein electrodeposition of said melt on said body is continuous until substantially all of said pore openings and discontinuities have been closed.

17. A process according to claim 12, wherein electrodeposition of said melt on said body is commenced as soon as said body is immersed in said melt.

18. A process according to claim 12, wherein said melt is a metal halide.

19. A process according to claim 18, wherein said melt is a metal fluoride.

20. A process according to claim 19, wherein said melt is predominantly cryolite.

21. A process according to claim 20, wherein said melt is composed of cryolite and alumina in 85–95:15–5 weight ratio.

22. A process according to claim 12, wherein said melt is magnesium fluoride.

23. A process according to claim 12, wherein said melt is a chloride.

24. A process according to claim 23, wherein said melt is an alkaline metal chloride.

25. A process according to claim 24, wherein said melt is a 55–95:45–5 by weight alkaline metal: $AlCl_3$ mixture.

26. A process according to claim 12, wherein the duration of immersion of said body in said melt is between 1 and 60 minutes.

27. A process according to claim 12, wherein said body on removal from said melt is allowed to cool to room temperature.

28. A process for providing a porous electroconductive carbon body with a coating which is oxidation agent impermeable at 400° C., which comprises:

(a) coating at least a part of said body with a refractory oxide, said coating having discontinuities which expose pores of said body to the atmosphere;
(b) immersing at least the thus coated part of said body in a salt melt for at least a part of said coating;
(c) applying a continuous voltage said voltage being below the disassociation voltage of said salt melt, using said carbon body as cathode;
(d) electrodepositing said salt melt on said body thereby closing substantially all of said pores and discontinuities; and
(e) removing said body from said salt melt before said coating has completely dissolved or disintegrated.

29. A process according to claim 28, wherein the oxide coated on said body includes particles that have a diameter between about 1μ and 200μ.

30. A process according to claim 29, wherein the oxide particles are alumina particles.

31. A process according to claim 29, wherein the entire body is coated with said oxide particles and said body is completely immersed in said melt.

32. A process according to claim 28, wherein said carbon body is coated to a thickness in the range of 200μ to 300μ.

33. A process according to claim 28, wherein said electrodeposition is continued until substantially all of said pores and discontinuities are filled.

34. A process according to claim 28, wherein said carbon body is sand-blasted prior to said coating step to provide said body with a clean, rough surface adapted to promote adhesion of said refractory oxide.

35. A process according to claim 28, wherein said coating is applied by brushing an aqueous suspension of oxide particles on the carbon, allowing the coating to dry, and then baking the coated carbon at elected temperature for several hours to cause said particles to adhere.

36. A process for providing a porous, electroconductive carbon body with a coating which is oxidation agent impermeable at 1000° C., which comprises:

(a) plasma coating substantially all of said body with alumina particles to a thickness of 100μ to 1000μ thereby forming on said body an adherent fused coating of alumina particles, said coating having discontinuities which expose pores of said body to the atmosphere;
(b) immersing said body in a electroconductive metal halide melt having a boiling point of at least 400° C.;
(c) applying a continuous voltage, said voltage being below the disassociation voltage of the metal halide, using said carbon body as cathode;
(d) electrodepositing said melt on said body thereby substantially filling all of said pores and said discontinuities; and
(e) removing said body from said melt before said fused alumina coating has completely dissolved.

* * * * *